US008092193B2

(12) United States Patent
Larson

(10) Patent No.: US 8,092,193 B2
(45) Date of Patent: Jan. 10, 2012

(54) SELF LUBRICATING PUMP

(75) Inventor: Steve Larson, Isanti, MN (US)

(73) Assignee: Diversified Dynamics Corporation, Minneapolis, MN (US)

( * ) Notice: Subject to any disclaimer, the term of this patent is extended or adjusted under 35 U.S.C. 154(b) by 541 days.

(21) Appl. No.: 12/369,816

(22) Filed: Feb. 12, 2009

(65) Prior Publication Data

US 2010/0202901 A1 Aug. 12, 2010

(51) Int. Cl.
*F04B 27/08* (2006.01)
*F01B 31/10* (2006.01)

(52) U.S. Cl. ..... 417/269; 417/295; 417/298; 92/153; 92/12.2; 92/71

(58) Field of Classification Search ..... 417/267, 417/510, 446, 447, 567, 569, 570, 571, 522, 417/523, 269, 552, 553, 295, 296; 92/153, 92/12.2, 57, 71
See application file for complete search history.

(56) References Cited

U.S. PATENT DOCUMENTS

| | | | |
|---|---|---|---|
| 4,651,380 | A | 3/1987 | Ogden |
| 5,435,701 | A | 7/1995 | Markerink |
| 5,957,667 | A | 9/1999 | Epp |
| 6,769,882 | B2 | 8/2004 | Cowans |
| 7,048,518 | B2 | 5/2006 | Oliviera et al. |
| 2003/0124002 | A1 | 7/2003 | Oliviera et al. |
| 2006/0024176 | A1 | 2/2006 | Ikeya |
| 2008/0273990 | A1 | 11/2008 | Pham et al. |

*Primary Examiner* — Karabi Guharay
*Assistant Examiner* — Elmito Breval
(74) *Attorney, Agent, or Firm* — Gerald E. Helget; Briggs and Morgan, P.A.

(57) ABSTRACT

A self-lubricating water-cooled piston-style water pump has a unitary pump housing with a crankcase in direct water communication with the water pump inlet. A low pressure chamber is in direct water communication with the crankcase. A compression chamber is in direct pressurized water communication with a high pressure water manifold through a one-way valve. A high pressure water pump outlet extends outwardly from the manifold to the exterior of the housing. A crankshaft is connected to a connecting rod and a plunger rod, both of which are lubricated and water-cooled in the crankcase. A compression plunger has water channels therethrough connected to the plunger rod and in water communication with the low pressure chamber. The plunger is reciprocal within the compression chamber. A second one-way valve is on the plunger in the compression chamber to let water into the compression chamber.

13 Claims, 6 Drawing Sheets

SELF LUBRICATING PUMP

BACKGROUND OF THE INVENTION

The present invention relates to a water pump and more particularly to a self-lubricating water-cooled piston-type water pump for use with carpet cleaning machines.

Piston or plunger-style water pumps used in carpet cleaning machines are well known. However, all such known pumps used in carpet cleaning machines are known to be lubricated with grease or heavy lubricant being applied to the components within the crankcase including the crankshaft, connecting rods, and the piston or plunger rods to ensure long life of the moving parts within the pump and to prevent premature wear.

Generally there are two types of pumps. The first type commonly used in hydraulics consists of a motor rotating a radially-set group of veins in a turbine-like assembly. Often these types of pumps include the electric motor within the pump housing and they are generally very complicated. Another type of pump structure is the piston cylinder arrangement with a crankcase having the piston disposed within the cylinder and reciprocating therein to create pressure and work with one-way valves.

Both of these general types of pumps have tried to cool and lubricate their moving parts with the fluid that is being pumped or compressed. However, such arrangements inclusive with motors are terribly complicated and subject to common failure.

The cooling of the piston pumps has been problematic in that they are generally cooled by the incoming and outgoing water to be pumped or by an external fan adjacent the pump housing. No water in these types of pumps enters into the crankcase to bathe its moving parts.

These cooling methods lead to premature wear of the moving parts due to the heat they generate during operation. Occasionally, bearings or seals in these prior known pumps fail and compressed water will leak into the crankcase. This pump breakdown leads to soiled water and grease leaking out of the pump and carpet cleaning machine onto the newly washed carpets creating a serious stain, which sometimes becomes indelible.

There is a need for a greaseless self-lubricating water-cooled water pump for a carpet cleaning machine that is simple in structure, long-lasting and will not detrimentally stain its surroundings should a seal break during operation.

SUMMARY OF THE INVENTION

A self-lubricating water-cooled piston-style water pump has a unitary pump housing with a crankcase in direct water communication with the water pump inlet. A low pressure chamber is in direct water communication with the crankcase. A compression chamber is in direct pressurized water communication with a high pressure water manifold through a one-way valve. A high pressure water pump outlet extends outwardly from the manifold to the exterior of the housing. A crankshaft is connected to a connecting rod and a plunger rod, both of which are lubricated and water-cooled in the crankcase. A compression plunger has water channels therethrough connected to the plunger rod and in water communication with the low pressure chamber. The plunger is reciprocal within the compression chamber. A second one-way valve is on the plunger in the compression chamber to let water into the compression chamber.

A principal object and advantage of the present invention is that the pump is simple in structure, self-lubricating with the water being pumped by it, and also water-cooled by the same water that the pump is compressing.

Another object and advantage of the present invention is that there is no grease or heavy oil lubricating the moving parts within the crankcase which may soil the carpet being worked upon should a seal or bearing fail during the pump's operation.

Another object and advantage of the present invention is that the pump is compact and of a low profile due to directly opposing pistons making the pump ideal for carpet cleaning machines.

Another object and advantage of the present invention is its use of thermoplastic bearings and seals which are not hydrophilic or moisture absorbent.

Another object and advantage of the present invention is its direct water inlet design into the crankcase for lubricating and cooling the crankcase components, the crankcase which is also in direct communication with the low pressure intake chamber which feeds water through the plunger into the compression chamber directly for compression and exhaust through the valved manifold and pump outlets.

DETAILED SPECIFICATION

Figure 1:
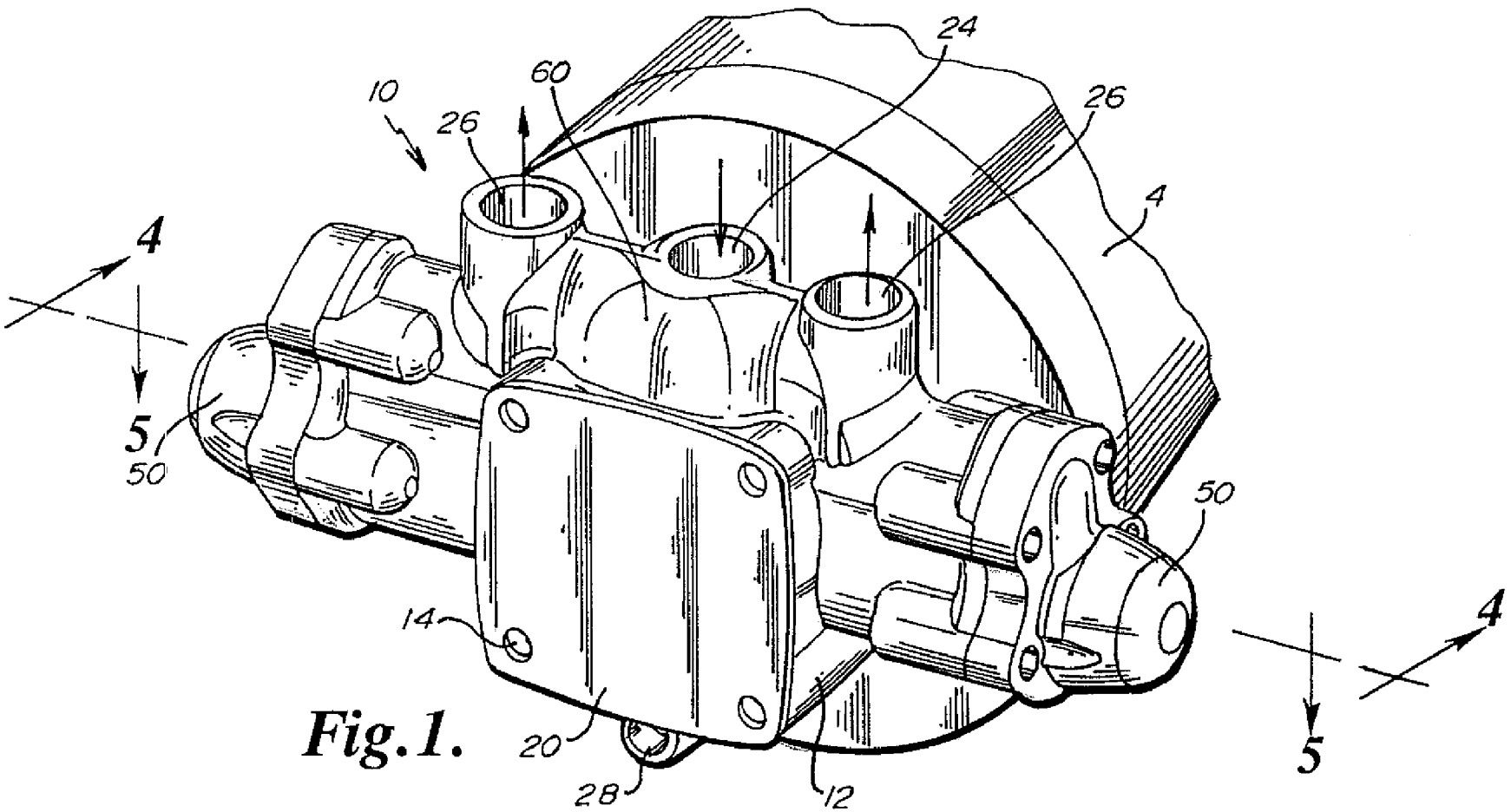
FIG. 1 is a perspective view of the self-lubricating water-cooled piston-type water pump of the present invention mounted to an electric motor partially broken away.
Figure 2:
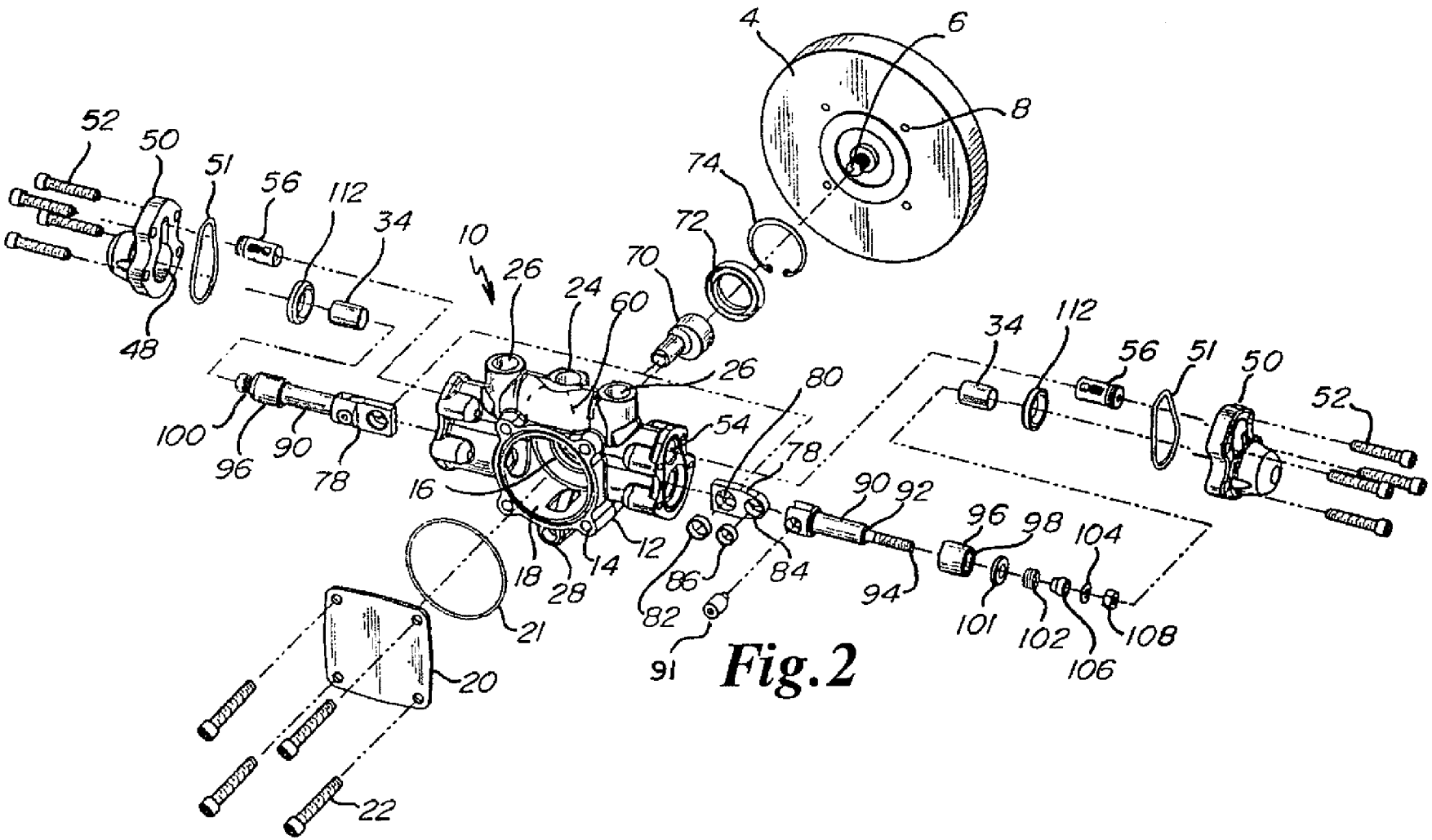
FIG. 2 is an exploded assembly drawing of the water pump.
Figure 3:
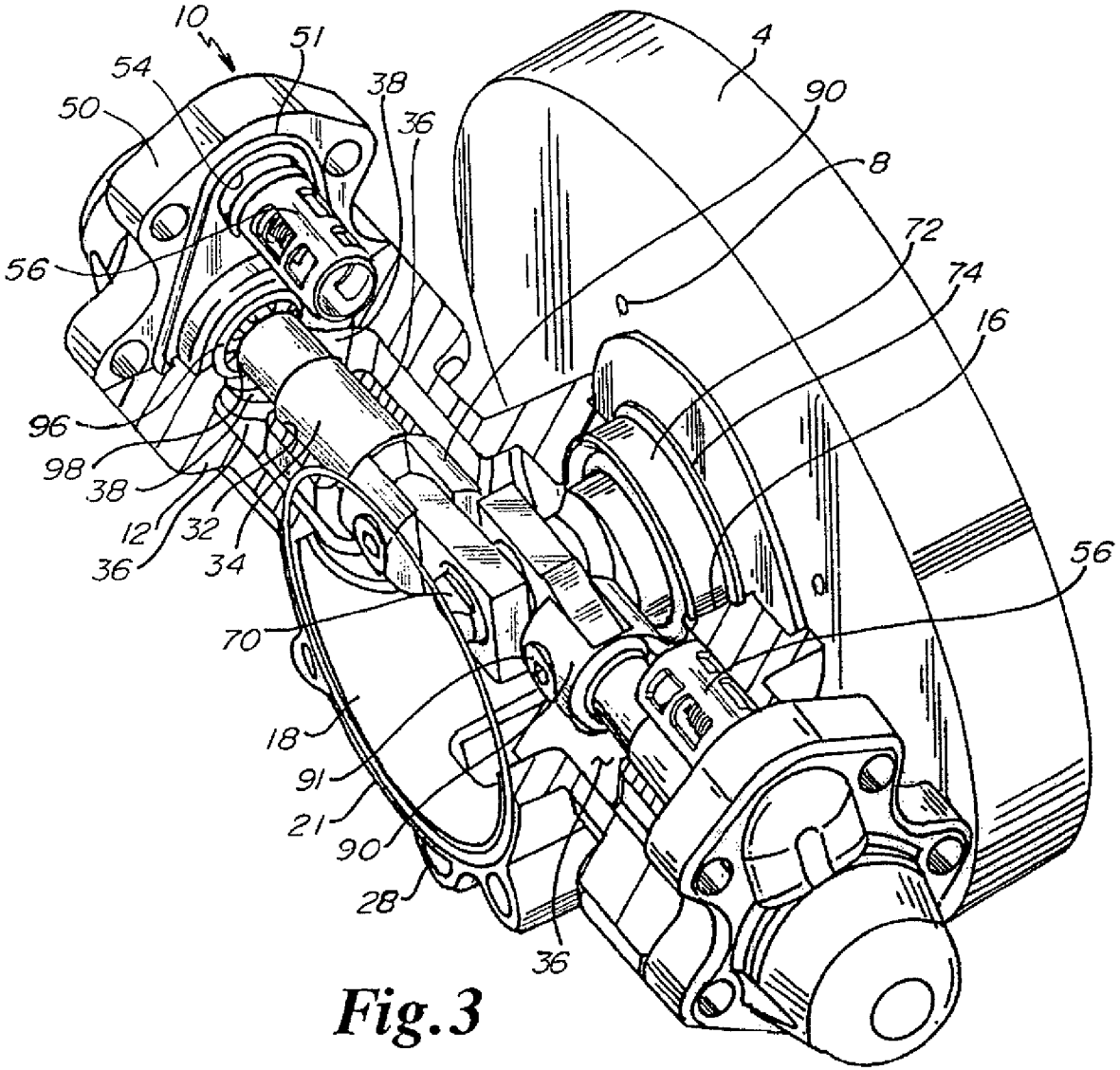
FIG. 3 is a perspective view similar to FIG. 1 with the top portion of the pump housing broken away.
Figure 4:
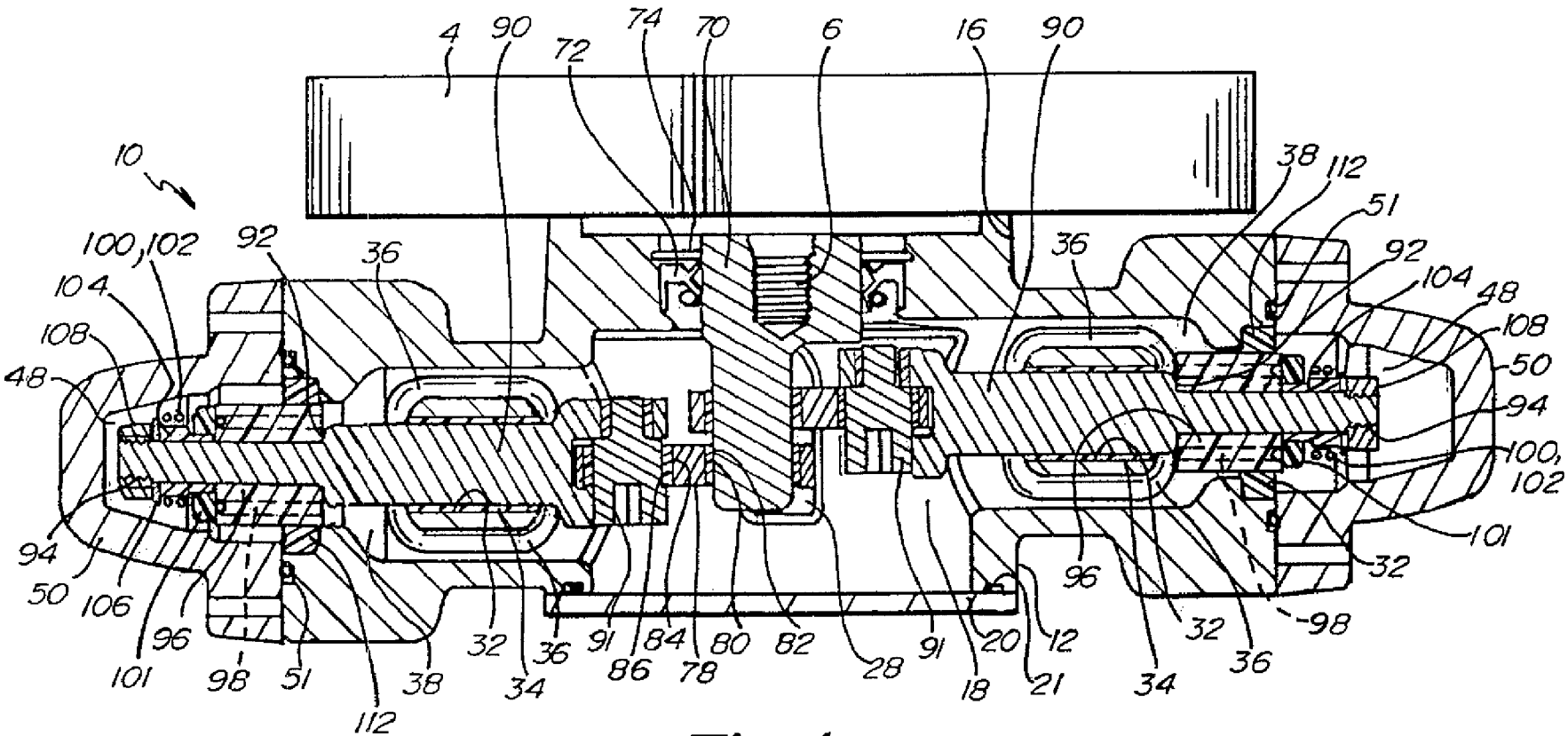
FIG. 4 is a cross-sectional view of the pump taken along lines 4-4 of FIG. 1.
Figure 5:
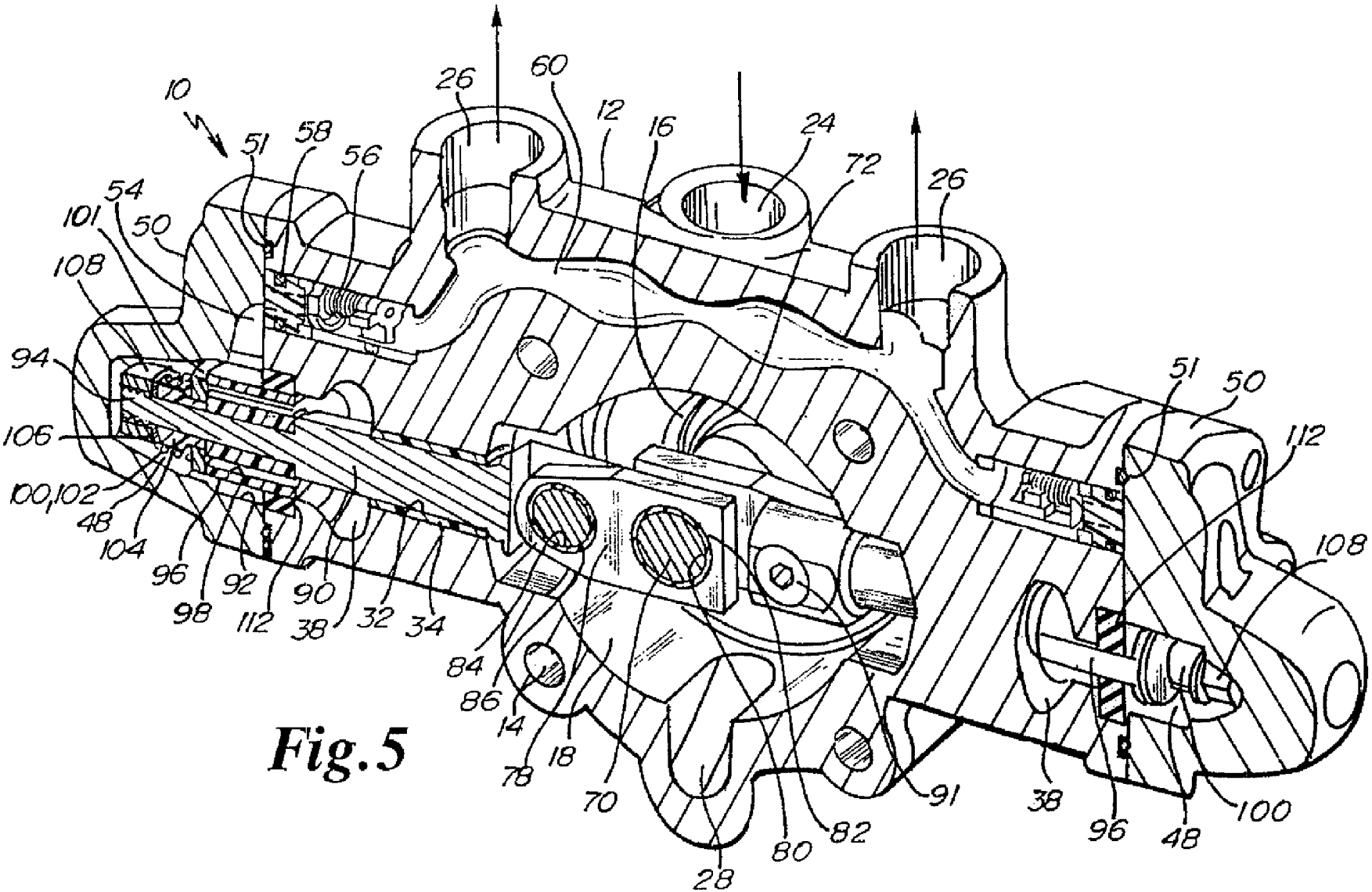
FIG. 5 is a cross-sectional view of the pump taken along lines 5-5 of FIG. 1.
Figure 6:
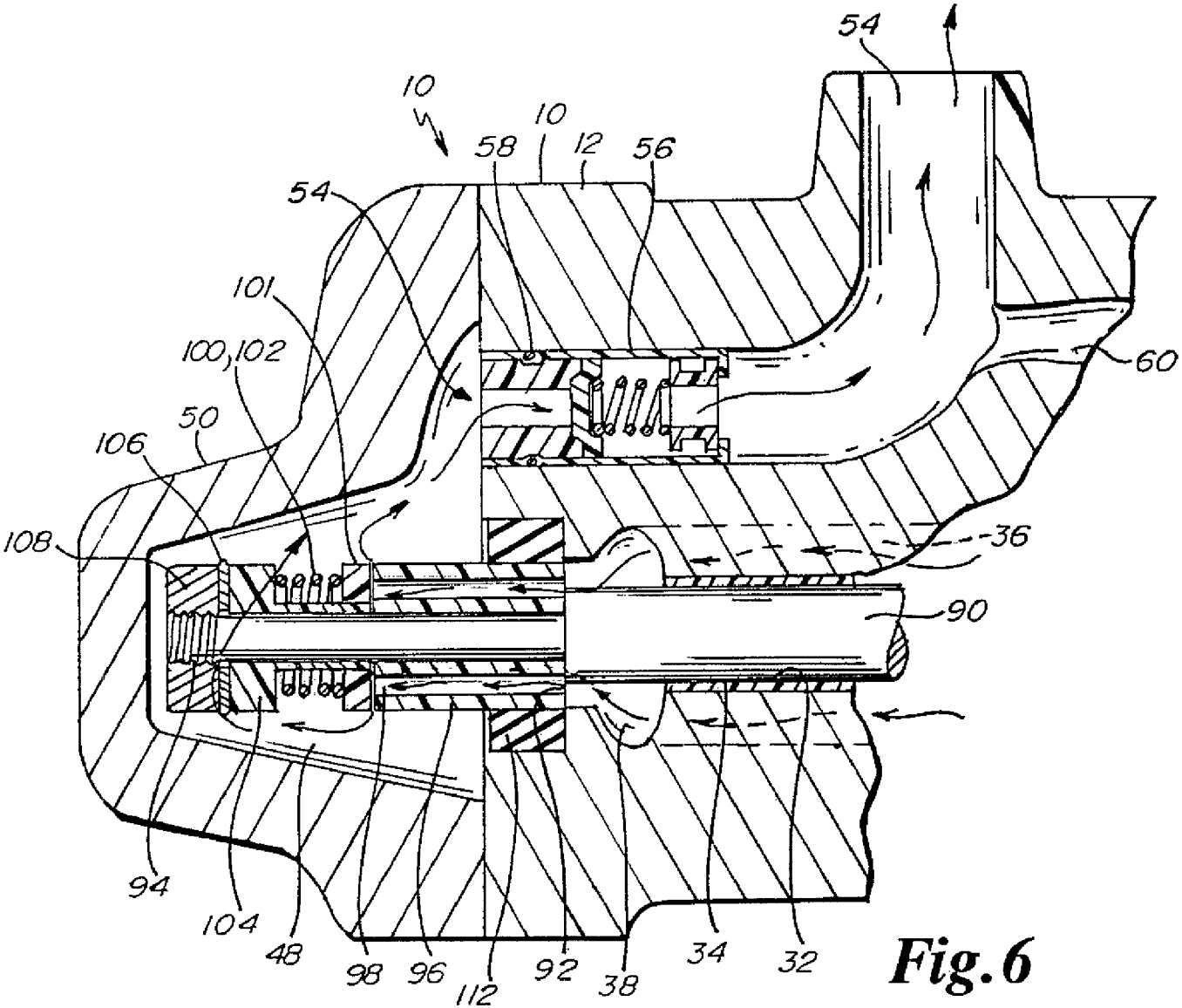
FIG. 6 is an enlarged, broken away view of the pump housing and pump head clearly showing the flow of water through the pump.

The self-lubricating water-cooled piston-type water pump 10 may be seen in FIGS. 1-6. Pump 10 is connected to motor 4, which has a threaded rotating drive-shaft 6, by way of motor mounts 8. The pump generally includes a unitary pump housing 12 with complementary motor mount apertures 14 which receive bolts 22 therethrough sealingly securing a cover plate 20 to housing 12 and the pump 10 to motor 4. Pump housing also includes pump inlet 24 for inflowing water to be pumped and pump outlets 26 for the pumped pressurized water. A drain 28 is also provided to clear the pump housing 12 of water should the pump remain outside in freezing temperatures.

More specifically referring to FIGS. 2-5, the details of water pump 10 may be seen. Pump housing 12 has a drive-shaft passageway 16 leading into the crankcase 18 for the threaded rotating driveshaft 6 of motor 4 to be operably located within the crank case 18. Cover plate 20 includes a gasket 21 to seal the access cover plate 20 to the pump housing by way of bolts 22.

The housing 12 has reciprocating plunger rod seats 32 with thermal plastic bearings 34 thereat. Conduits, channels or passageways 36 are provided to allow water to flow from the crankcase to the low pressure intake chamber 38. Compression chamber 48 is formed by pump head 50 sealed to pump housing 12 with gasket 51 by way of bolts 52. The compression chamber 48 has an outlet port 54 in which is seated at the pump housing an outlet valve 56 and affixed thereafter by seal 58. The outlet valve 56 renders the compression chamber 48 in flow communication with the output manifold 60 and thus the pump outlets 26.

With the structure of the pump housing 12 explained, the moving parts within the pump may now be appreciated. The crankshaft 70 is secured to the threaded rotating driveshaft 6 of motor 4 and secured to the housing through passageway 16 and held in place by bolts 22. The seal 72 is indexed with a housing pilot (not shown) to hold the seal 72 in place and sealing held thereat with snap ring 74. As can be seen, the inlet port 24 brings water into the crankcase 18 directly about the crankshaft 70. Connecting rods 78 have crankshaft seats or apertures 80 supporting thermal plastic bearings 82 which are connected to the crankshaft 70. Connecting rods 78 also have plunger rod seats or apertures 84 with bearings 86 thereat for securing to the plunger rods 90 thereat with wrist pin 91.

Each plunger or piston rod 90 has a piston or plunger seat 92 while being threaded at its end 94. Plunger or piston 96 has water channels 98 therethrough and a distal inlet valve 100 secured onto the threaded end 94 of plunger rod 90. Inlet valve 100 includes inlet valve washer 101, valve spring 102, spacer 104, conical washer 106 and a nut 108 securing the inlet valve 100 to the threaded end 94 of the plunger rod. Plunger rod is seated and passes through plunger rod bearings 34 in the housing 12 while plunger 96 is seated within high-pressure plunger seal 112 (See FIG. 6) which suitably may be made of BUNA-N (nitrile elastomer) SBR (styrene-butadiene rubber), EDPM (ethylene-propylene-diene monomer), Vitro® or Teflon® (fluoroelastomer) or the like.

The operation and movement of the mechanical parts within pump housing 12 may be appreciated with a viewing of FIGS. 3-6. As threaded rotating driveshaft 6 of motor 4 rotates, crankshaft 70 rotates moving connecting rods 78 in opposite directions which in turn move plunger rods 90 in opposite directions so that plungers 96 are timed as to compress water within compression chambers 48 in opposite time of one another. Inlet valves 100 let water into the compression chamber and high-pressure one-way valves 56 let pressurized water out of the compression chamber 48 into the output manifold 60 to the outlet ports 54.

The flow of the water to be pumped by water pump 10 may now be appreciated. The water enters the pump housing through pump inlet 24 directly into the crankcase 18. Water within the crankcase 18 lubricates and cools the crankshaft 70, connecting rods 78 and plunger rods 90 along with seals and bearings 72, 82 and 86. Water passes directly through the conduits or channels 36 to the low-pressure intake chamber 38. When the plunger 96 is not compressing the water enters into compressions chambers 48. That is, the inlet water under low pressure flows through the water channels 98 of plunger 96 as inlet valve 100 opens and allows the water to enter into the compression chambers 48. Upon compression by the plunger 96, inlet valve 100 closes and the water is pressurized and directed through the high-pressure plunger one-way valve 56 into the output manifold 60 and out through the pump outlets 26 under the pressure action of the water pump 10.

Should any seal or bearing fail within the water pump 10, no detrimental grease or heavy lubricant is present to enter into the carpet cleaning machine and hence onto the carpet possibly permanently soiling the carpet being cleaned.

While particular elements, embodiments and applications of the present invention have been shown and described, it will be understood that the invention is not limited thereto since modifications may be made by those skilled in the art. It is therefore contemplated by the appended claims to cover such modification and to incorporate such features which come within the spirit and scope of this invention.

The invention claimed is:

1. A self-lubricating water-cooled piston-type water pump, comprising:

(a) a unitary pump housing with a crankcase in direct water communication with a water pump inlet;

(b) a low pressure chamber in direct water communication with the crankcase;

(c) a compression chamber in direct pressurized water communication with a high pressure water manifold through a one-way valve, the manifold having a high pressure water pump outlet;

(d) a crank shaft connected to a connecting rod and a plunger rod lubricated and water-cooled in the crankcase;

(e) a compression plunger with water channels therethrough, connected to the plunger rod, in water communication with the low pressure chamber, the plunger being reciprocal within the compression chamber; and (f) a second one-way valve on the plunger in the compression chamber to let water into the compression chamber.

2. The pump of claim 1, further comprising by diametric opposition a second connecting rod and a second plunger rod connected to the crank shaft in water communication with a second low pressure chamber, a second plunger being reciprocal within a second compression chamber and a third one-way valve on the plunger in a second compression chamber to let water into the compression chamber.

3. The pump of claim 2, the second compression chamber in direct pressurized water communication with the high pressure water manifold through a fourth one-way valve.

4. The pump of claim 1, further comprising water resistant thermoplastic bearings on the crankshaft and connecting rod and plunger rod and a water resistant elastomeric high pressure seal around a portion of the plunger.

5. The pump of claim 1, further comprising a crankcase access cover sealable to the pump housing opposite an electric motor.

6. The pump of claim 1, further comprising a head sealable to the pump housing forming the compression chamber.

7. The pump of claim 1, the manifold having a second high pressure water pump outlet.

8. A self-lubricating water-cooled piston-type water pump, comprising:

(a) a unitary pump housing with a crankcase in direct water communication with a water pump inlet;

(b) two low pressure chambers in direct water communication with the crankcase;

(c) two compression chambers in direct pressurized water communication with a high pressure water manifold each through a one-way valve, the manifold having a high pressure water pump outlet;

(d) a crank shaft connected to at least two connecting rods and at least two plunger rods lubricated and water-cooled in the crankcase;

(e) two compression plungers with water channels therethrough, each connected to one of the plunger rods, in water communication with the low pressure chambers, the plungers being reciprocal within one of the compression chambers; and (f) a second one-way valve on the plunger in the compression chamber to let water into the compression chamber.

9. The pump of claim 8, further comprising water resistant thermoplastic bearings on the crankshaft and connecting rods and plunger rods and a water resistant elastomeric high pressure seal around a portion of each plunger.

10. The pump of claim 8, further comprising a crankcase access cover sealable to the pump housing opposite an electric motor.

11. The pump of claim 8, further comprising a head sealable to the pump housing forming the compression chamber.

12. The pump of claim 8, the manifold having a second high pressure water pump outlet.

13. A self-lubricating water-cooled piston-type water pump, comprising:

(a) a unitary pump housing with a crankcase in direct water communication with a water pump inlet;

(b) two low pressure chambers in direct water communication with the crankcase;

(c) two diametrically opposing compression chambers in direct pressurized water communication with a high pressure water manifold each through a one-way valve, the manifold having a high pressure water pump outlet;

(d) a crank shaft connected to at least two connecting rods and at least two plunger rods lubricated and water-cooled in the crankcase;

(e) two compression plungers with water channels therethrough, each connected to one of the plunger rods, in water communication with the low pressure chambers, the plungers being reciprocal within one of the compression chambers;

(f) a second one-way valve on each plunger in the compression chamber to let water into the compression chamber; and (g) water resistant thermoplastic bearings on the crankshaft and connecting rods and plunger rods and a water resistant elastomeric high pressure seal around a portion of each plunger.

* * * * *